United States Patent [19]

Maddison et al.

[11] Patent Number: 4,573,612

[45] Date of Patent: Mar. 4, 1986

[54] LIQUID SOAP DISPENSER

[75] Inventors: David Maddison, Worthing; Christopher Dawson, Hassocks, both of England

[73] Assignee: Kimberly-Clark Limited, Kent, England

[21] Appl. No.: 555,536

[22] Filed: Nov. 28, 1983

[30] Foreign Application Priority Data

Mar. 12, 1982 [GB] United Kingdom ..... 8234623

[51] Int. Cl.[4] ..... B65D 35/22

[52] U.S. Cl. ..... 222/94; 222/136; 222/145; 222/181

[58] Field of Search ..... 222/94, 156, 158, 136, 222/145, 181, 207, 212, 214, 95, 386.5, 105, 107, 92, 380, 377, 209, 213, 215, 541, 548

[56] References Cited

U.S. PATENT DOCUMENTS

| | | | |
|---|---|---|---|
| 2,772,817 | 12/1956 | Jauch | 222/207 |
| 2,933,376 | 4/1960 | McBrien | 222/207 |
| 2,980,177 | 4/1961 | Glasson | 222/386.5 X |
| 3,081,911 | 3/1963 | Scholle | 222/107 |
| 3,178,059 | 4/1965 | Packwood, Jr. | 222/256 X |
| 3,263,874 | 8/1966 | Porter et al. | 222/541 |
| 3,825,042 | 7/1974 | Glantz | 222/158 X |
| 3,881,639 | 5/1975 | Herip | 222/548 X |
| 4,018,363 | 4/1977 | Cassia | 222/181 X |
| 4,036,406 | 7/1977 | Jespersen et al. | 222/494 X |
| 4,130,224 | 12/1978 | Norman et al. | 222/207 X |
| 4,316,555 | 2/1982 | Smith | 222/105 X |
| 4,349,133 | 9/1982 | Christine | 222/207 X |
| 4,391,308 | 7/1983 | Steiner | 222/325 X |
| 4,391,309 | 7/1983 | Steiner | 222/325 X |

FOREIGN PATENT DOCUMENTS

| | | | |
|---|---|---|---|
| 0621966 | 6/1961 | Canada | 222/181 |

*Primary Examiner*—Joseph J. Rolla
*Assistant Examiner*—Nils E. Pedersen
*Attorney, Agent, or Firm*—Fidelman, Wolffe & Waldron

[57] ABSTRACT

A liquid dispenser has a reservoir to which a refill container may be connected via a fitment in order to determine the level of soap in the dispenser through a window of the reservoir. The refill container further has a dispensing tube through which a predetermined amount of soap is dispensed on actuation of the lever.

The tube and fitment are both mounted to a mounting component to which the bag is fixed, a duct being provided between the tube and fitment for liquid communication thereto.

14 Claims, 13 Drawing Figures

LIQUID SOAP DISPENSER

Figure 1:
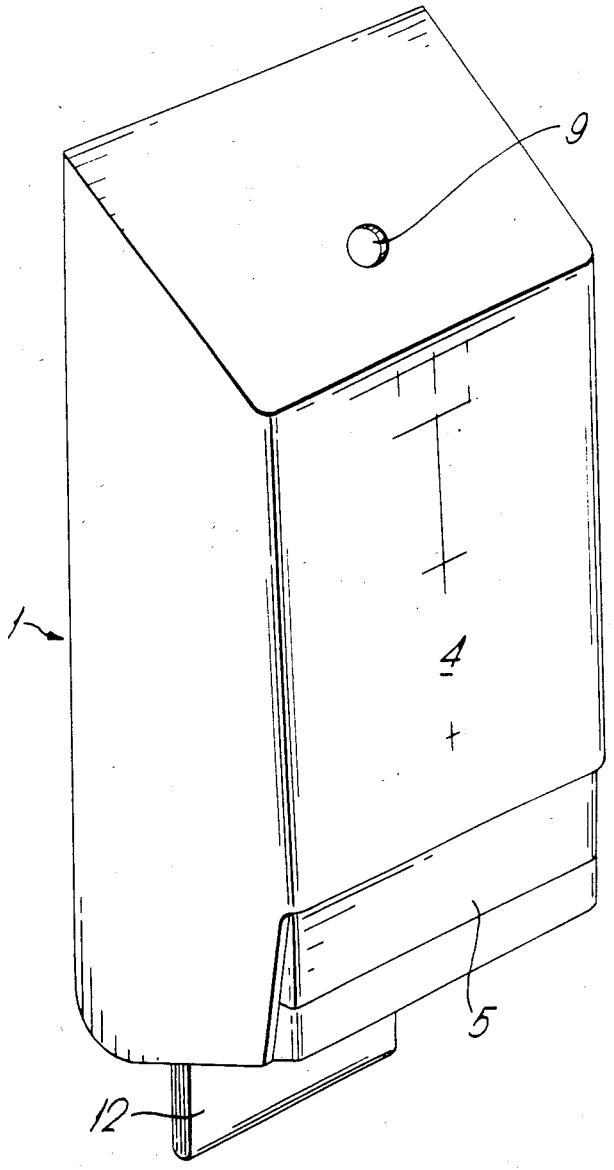

The present invention relates to dispensers for dispensing liquid soap.

Liquid soap dispensers are well known and generally comprise a flexible or rigid replaceable soap refill container and a hand operable lever arranged to squeeze a tube either forming a part of the refill container or the main body of the dispenser and connected to the container. The operator merely keeps operating the lever until the refill is empty. There is no indication that this is about to happen.

Where a number of dispensers are provided it is clearly desirable to be able to know when the dispensers are nearly empty and then fit new refills.

A liquid dispenser according to the present invention is characterised by the presence of a reservoir to which the refill container may be connected and the level of soap in which may be determined.

A dispenser according to the invention thus enables a supervisor or the like readily to determine when a new refill is required.

A "window" may be provided in the dispenser through which the reservoir level may be seen.

According to another aspect of the invention a liquid refill container for the dispenser includes a resilient dispensing tube in liquid communication with the container, and a reservoir connection fitment providing in use liquid communication between the container and a dispenser reservoir whilst the tube remain available for dispensing of soap therethrough.

Preferably the tube and fitment are both mounted to or form part of a mounting component to which the bag is fixed.

In a preferred embodiment the mounting component is provided with a duct between the fitment and tube, which duct is partially formed in use by the container collapsing onto the component.

In operation of the preferred embodiment, when the container is empty and when the tube is squeezed by the dispensing lever, liquid is sucked from the reservoir thus lowering the reservoir liquid level which can be seen through a "window". The janitor can thus be warned well in advance of the time when the refill must be replaced. When the new refill is fitted a suitable connection on the fitment ensures the reservoir is replenished and when the tube is squeezed again the liquid in the container is pumped directly from the container.

Preferably the fitment is provided with a tear-away cover opening and the cover may be rotatable to align the torn away opening with a corresponding reservoir opening. A lock means may be provided for the cover or fitment to maintain the fitment and thus the refill in engagement with the reservoir. Preferably the lock comprises a recess or projection on the covers so that as the cover is rotated to open the refill to the reservoir the lock engages with the reservoir or other part of the dispenser frame.

The reservoir can be dismountable from the dispenser frame and the refill reversable in the frame so that the refill is operable in a conventional way without the reservoir facility. This arrangement is appropriate for hospital use where the use of a reservoir might be objectionable in view of possible bacterial contamination.

Figure 2:
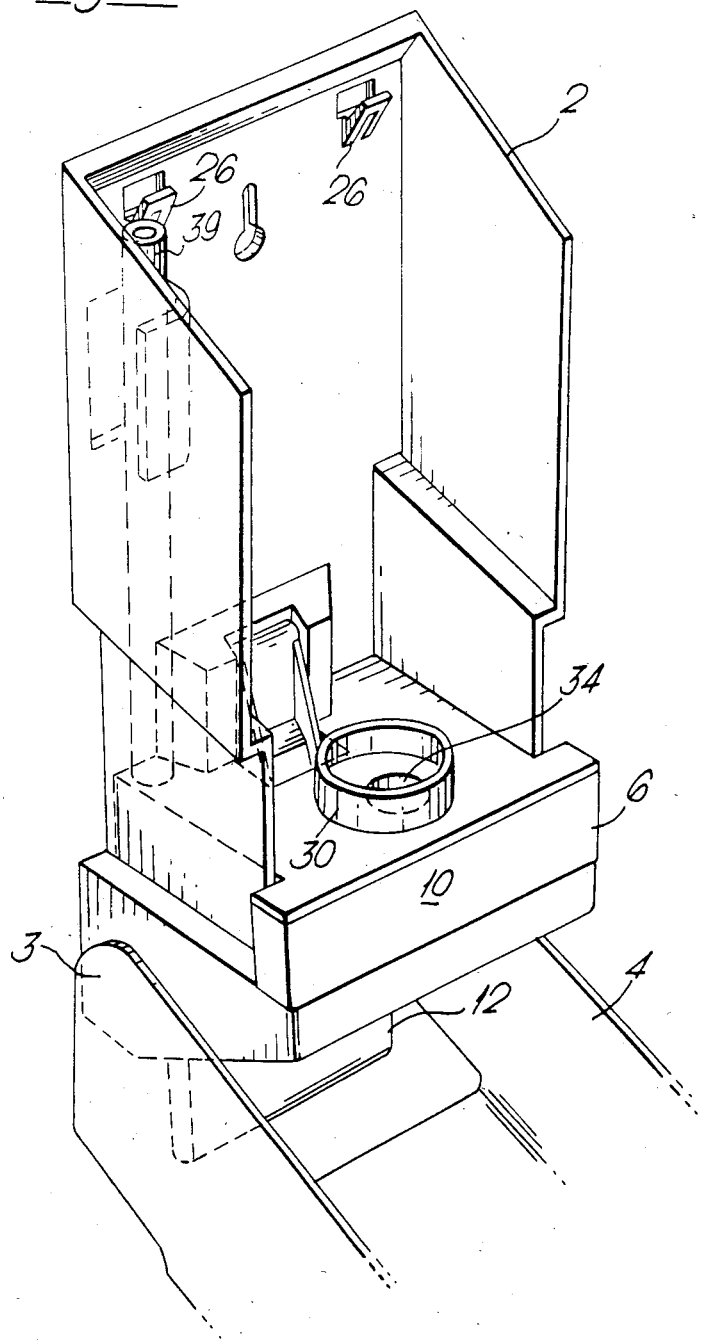
Figure 3:
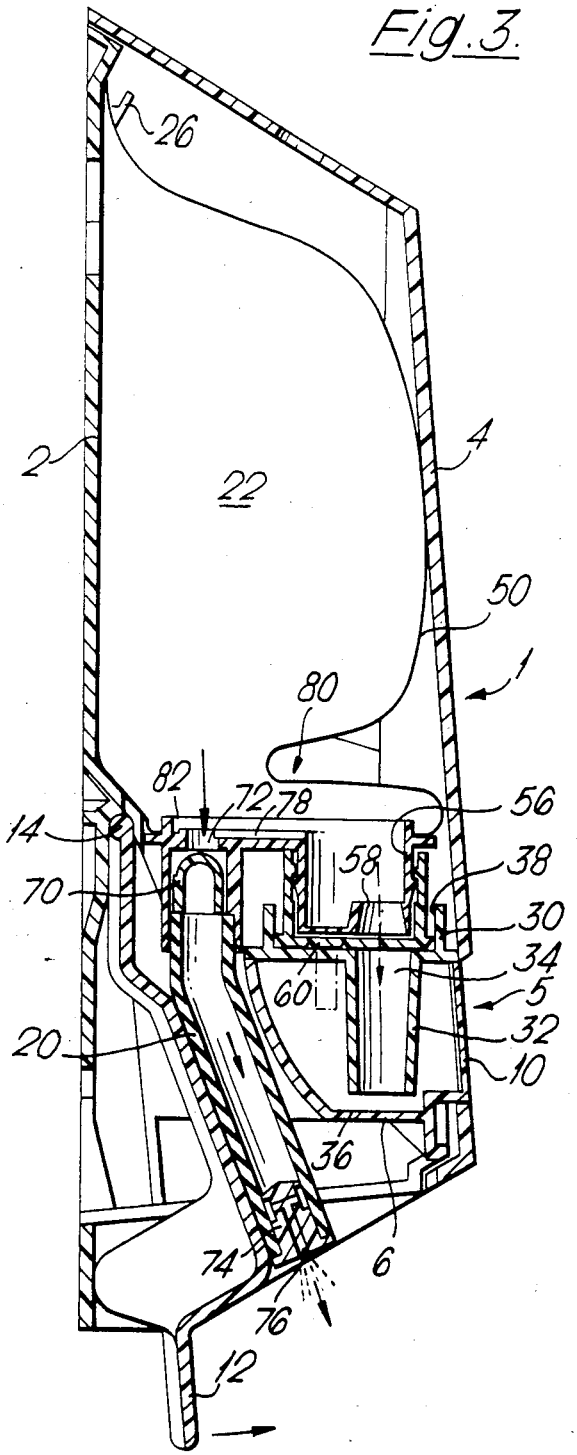

Embodiments of the invention will now be described by way of example with reference to the accompanying drawings in which:

FIG. 1 is a perspective view of a dispenser according to the invention in the closed position, FIG. 2 is a perspective view showing the dispenser of FIG. 1 open with the refill removed, FIG. 3 is a side sectional view of the dispenser of FIG. 1 with the refill in place.

Figure 4:
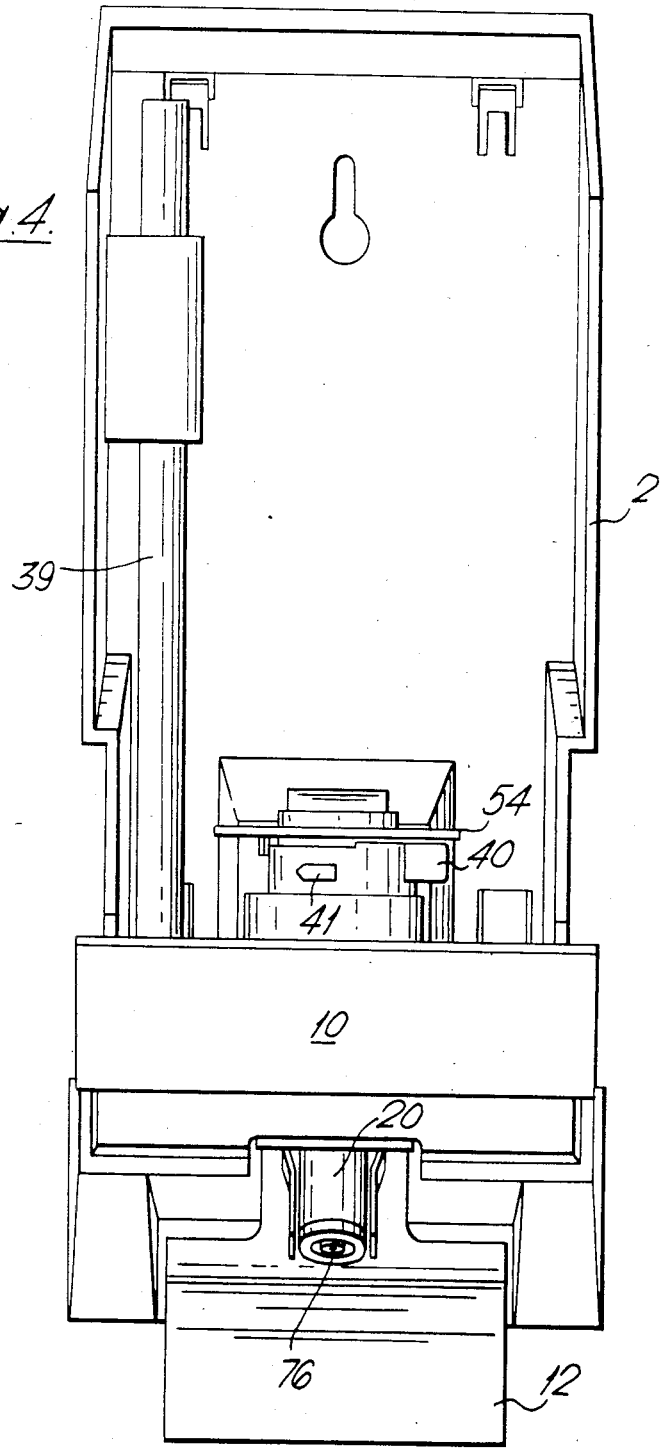
Figure 5:
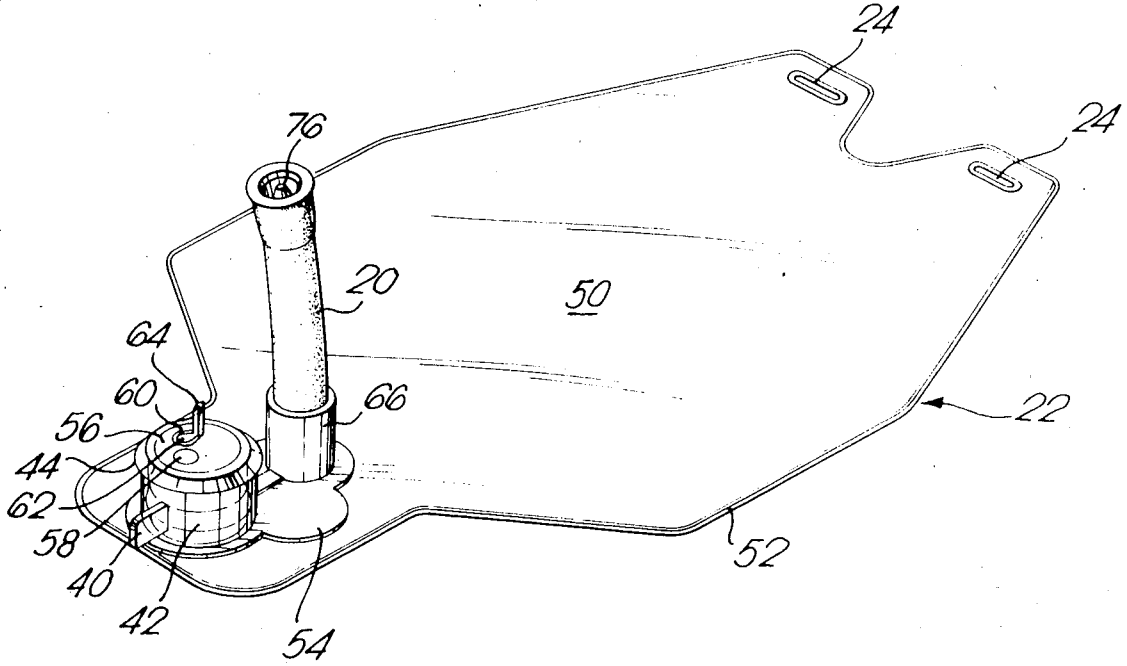
Figure 6:
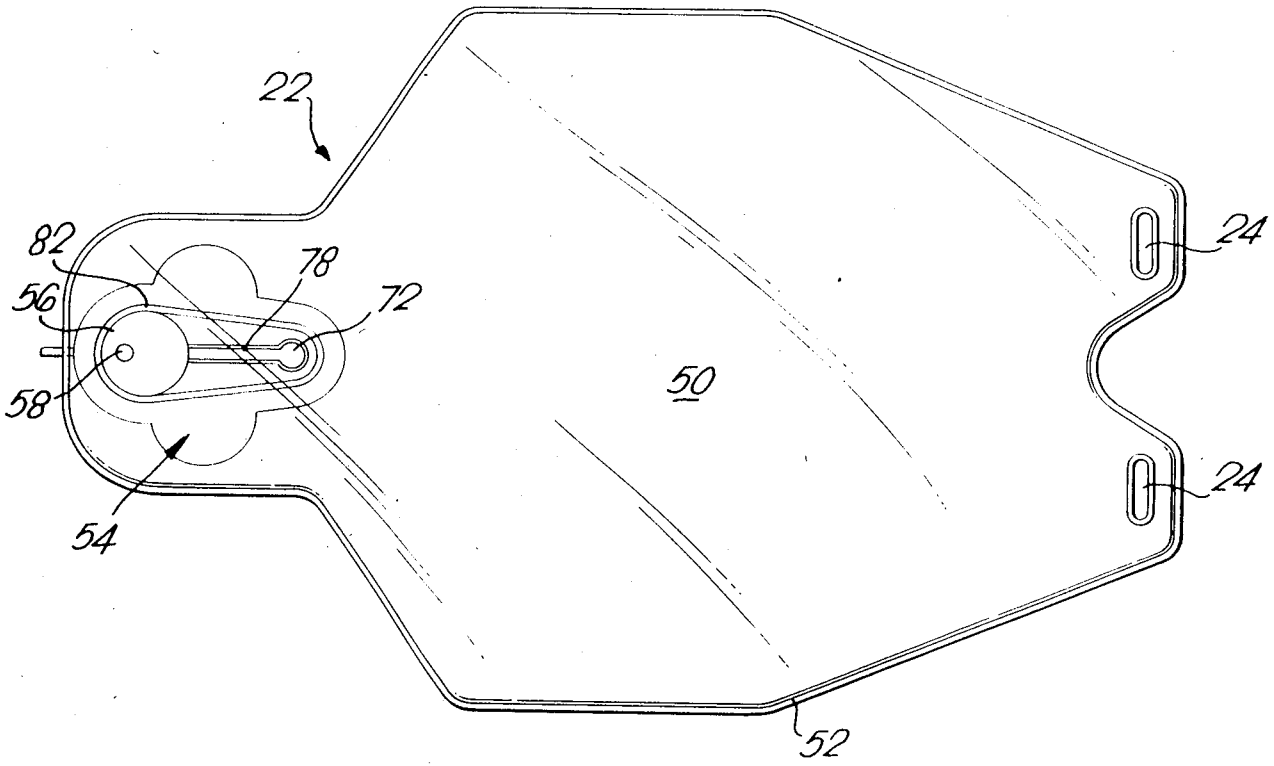
Figures 7A, 7B:
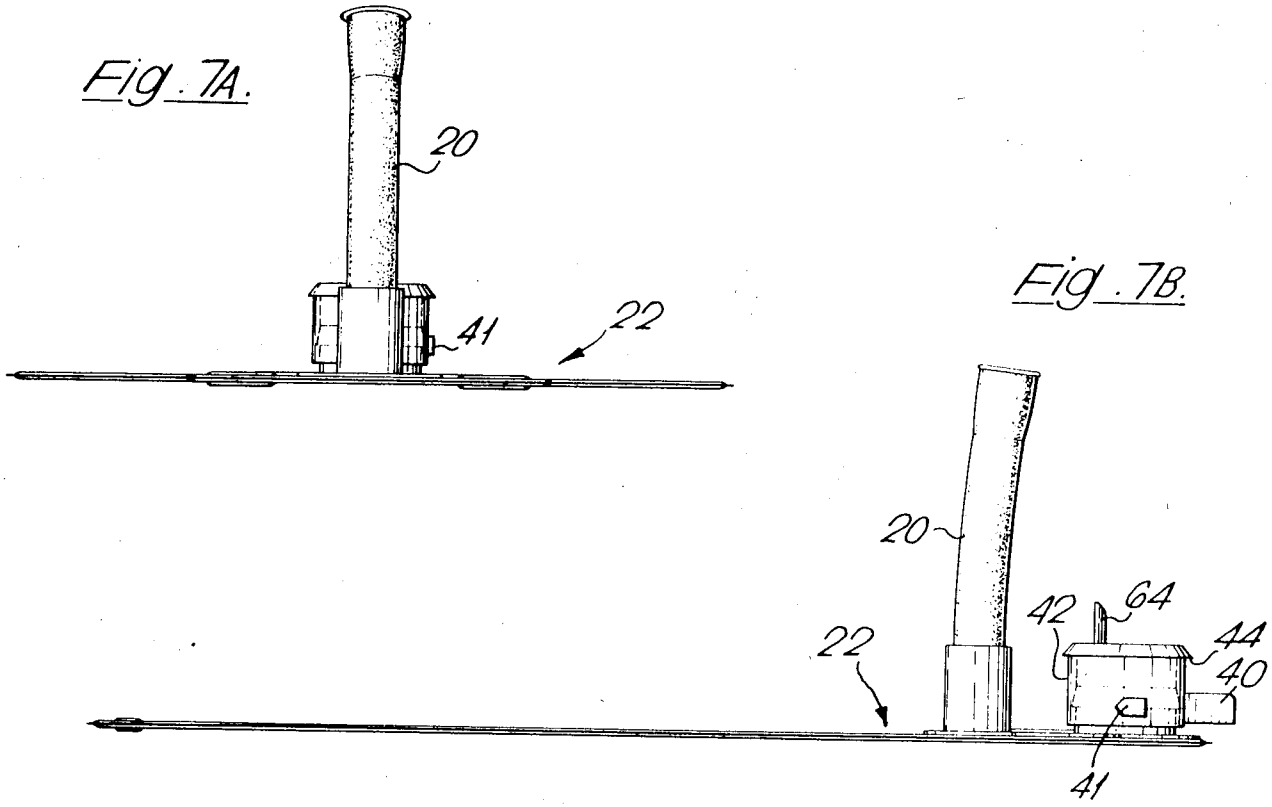
Figure 8C:
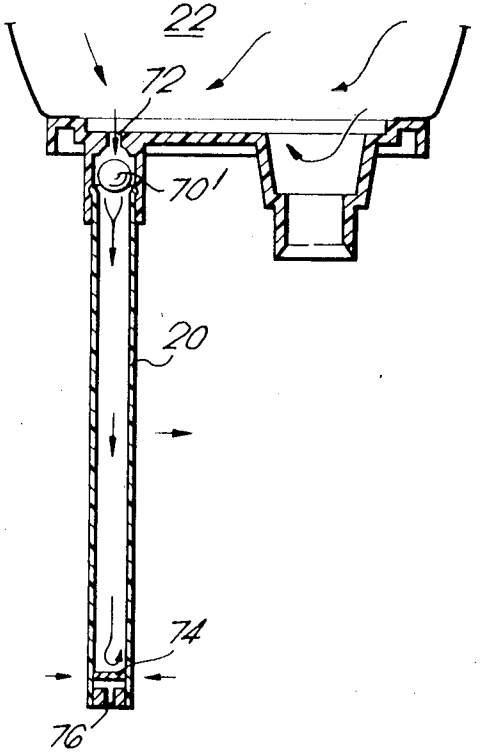
Figure 8B:
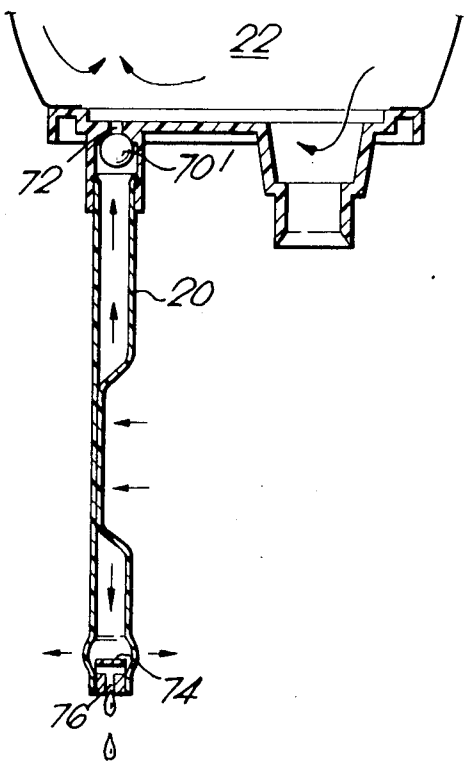
Figure 8A:
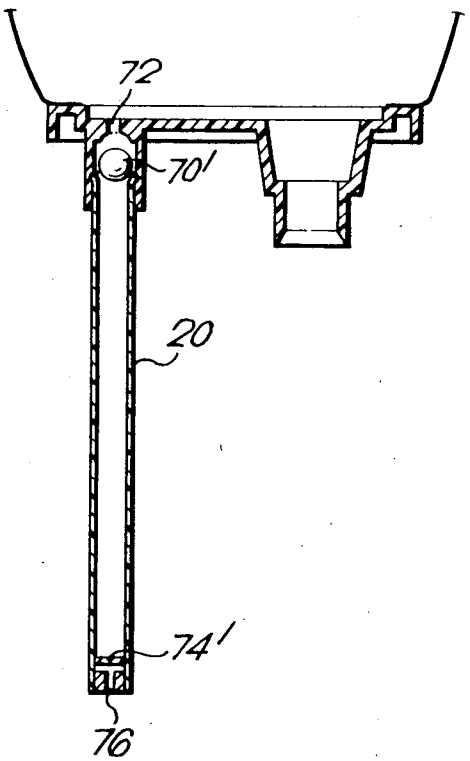
Figure 9B:
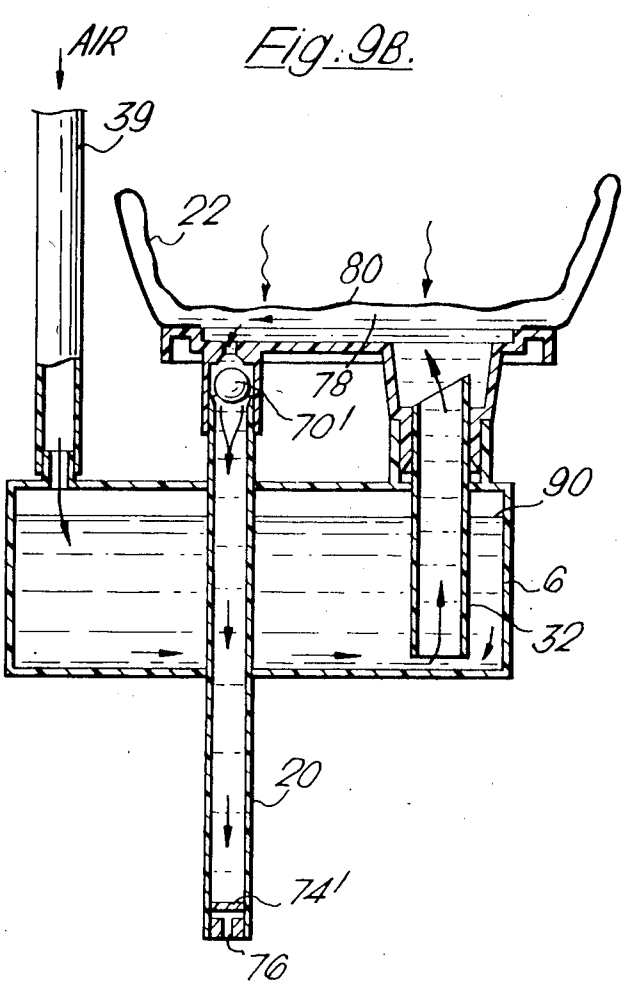
Figure 9A:
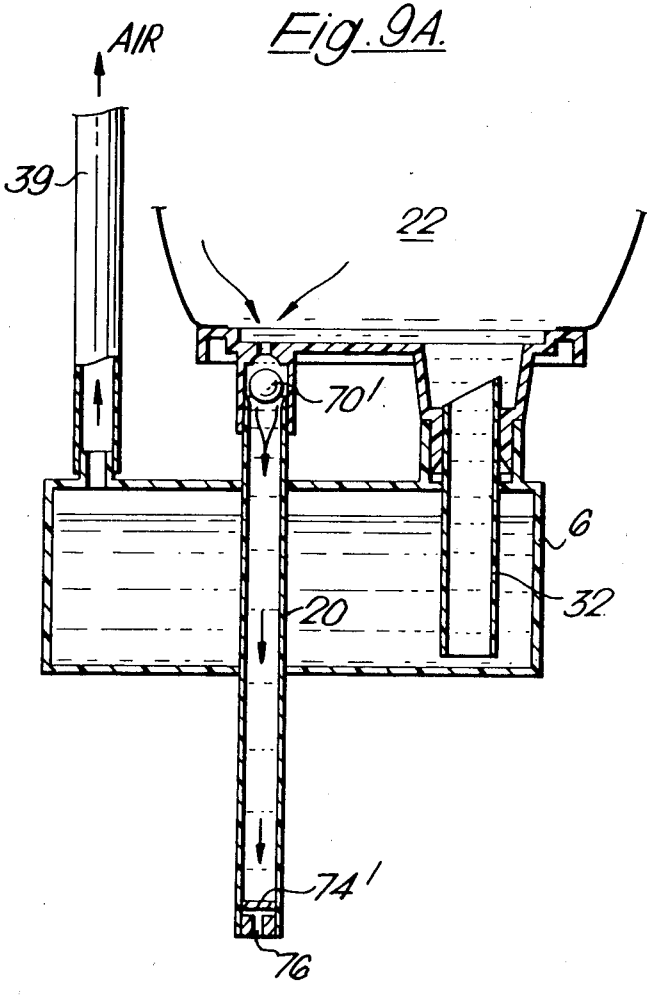

FIG. 4 is a front view of the dispenser of FIG. 1 open and with the refill fitment in place but refill container removed, FIG. 5 is a perspective view of the refill for the dispenser of FIG. 1 when empty showing a container fitment and dispenser tube, FIG. 6 is a view of the refill of FIG. 5 showing the ducting arrangements between fitment and dispenser tube, FIGS. 7A and 7B are side views of the refill of FIG. 5, FIGS. 8A, B and C are diagrams of the refill dispenser tube operation of the refill of FIG. 5 and FIGS. 9A and B are diagrams of the dispenser reservoir operation of the dispenser of FIG. 1.

The dispenser 1 as shown in FIGS. 1 and 2 has a frame 2 to which is pivotally mounted at 3 a front cover 4 in which is an opening 5. A reservoir 6 is removably mounted in frame 2 and has at least its front 10 made of clear plastics material so that a "window" is formed with opening 5 to view the level of liquid in the reservoir. The front cover has a lock (not shown) with a keyhole 9.

A hand operable lever 12 extends below the frame and is pivotally mounted thereto at 14 (see FIG. 3) so that it can be pulled from the rear to the front of the dispenser to squeeze a refill tube 20.

The refill 22 has eye holes 24 so that it may be hung from hooks 26 in the rear wall of frame 2 in a position in which the tube 20 projects below the frame 2. Other features of the refill will be described hereafter.

The reservoir 6 which can be slid out of the frame forwardly for adaption of the dispenser to a hospital mode has a refill engaging portion 30 in which is a pipe portion 32 extending from an opening 34 to a position near the bottom 36 of the reservoir. A locking means comprising a locking projection or recess (not shown) in or near the portion 30, engages with a corresponding recess or projection (here shown as a projection) 41 on a cover 42 of refill 22 (see FIG. 5). The locking means ensures the refill is locked securely to the reservoir and thus into the dispenser frame. An inner cylindrical surface 38 of portion 30 forms a sealing surface for a thin sealing portion 44 of refill cover 42. The reservoir has an air vent tube 39 "open" to atmospheric pressure, the tube 39 extending from the reservoir to the top of the frame 2 in order to equalize the pressures in the dispenser and further to provide a visible liquid level between air and soap. Tab 40 serves to turn cover 42.

The refill 22 has a thin walled flexible container 50 formed of two sheets of plastics material welded together around the edge at 52 (see FIG. 5). Welded to the container 50 is a member 54 having a hollow cylindrical fitment 56 in the top of which as seen in FIG. 5 is a hole 58. Cover 42 can be turned axially on fitment 56 to bring into registration with hole 58 a cover tear away hole 60 which is covered by a tear away tab portion 62 extending from which is a tab 64. Member 54 has tube socket 66 into which is glued or otherwise fixed the rubber or plastics flexible tube 20.

Tube 20 has an inner valve (see FIG. 3) 70 (shown unseated in FIG. 3) which seats onto the member 54 at 72. An outer tube valve 74 is provided at the tube outlet and forms at its outlet a dispensing nozzle 76.

Within member 54 and connecting (see FIG. 6) seating 72 in socket 66 with fitment 56 is a duct 78 which is open sided when the refill is full but forms part of a closed duct when a refill container wall portion 80 collapses onto a sealing edge 82 (see FIG. 3) of member 54.

Operation of the dispenser is shown in FIGS. 8A–C and FIGS. 9A–B.

The tube dispensing operation is shown in FIGS. 8A–C. In FIG. 8A the dispenser tube 20 is in the rest position with inner valve 70' open to container 22 and outer valve 74' closed to nozzle 76. The lever 12 is then pulled forwards squeezing tube 20 as in FIG. 8B (actually the lever squeezes the rear of the tube), valve 70' closes, 74' opens and soap is dispensed from nozzle 76. On release of lever 12 the tube resiles and with the help of gravity returns lever 12 to the rest position, valve 74' closes, 70' opens and tube 20 refills. The two valves 70' and 74' thus act together to dispense a predetermined amount of soap from the tube 20.

Refill 22, which has been fitted as shown in FIG. 9 to reservoir 6 fills on fitting the reservoir. As the refill empties the container slowly collapses until when it is empty a front wall portion 80 of the container collapses on member 54 sealing on edge 2. At this point the reservoir is connected to tube 20 by duct 78. At the next operation and release of lever 12 liquid is sucked up tube 32 from reservoir 6 across duct 78 through valve 70' into tube 20. The level 90 of liquid in reservoir 6 drops and this is visible through the window in the front of the dispenser. The reservoir is large enough to last for some time until the janitor does his periodical inspection.

What we claim is:

1. A refill container for a liquid dispenser, and comprising:

a dispensing tube through which said liquid is dispensed from said dispenser;

container means for furnishing a primary supply of liquid to said dispensing tube during use and to a reservoir providing an auxiliary supply of liquid for said dispensing tube; and a fitment means for providing liquid communication between said container means and said reservoir in order to supply said reservoir from said container means and for providing for said auxillary supply of liquid to said dispensing tube upon substantial depletion of said primary supply.

2. A refill container as claimed in claim 1 wherein said tube has an inner valve and an outer valve operable in concert to dispense a predetermined amount of soap.

3. A refill container as claimed in claim 1 wherein said tube and said fitment are both mounted to a mounting component to which said container means in the form of a bag is fixed.

4. A refill container as claimed in claim 3 wherein said mounting component is provided with a duct between said fitment and said tube, which duct is partially formed in use by said bag collapsing onto the component.

5. A refill container as claimed in claim 1 wherein said tube and said fitment form a part of a mounting component to which said container means in the form of a bag is fixed.

6. A refill container as claimed in claim 5 wherein said mounting component is provided with a duct between said fitment and said tube, which duct is partially formed in use by said bag collapsing onto the component.

7. A refill container as claimed in claim 1 wherein said fitment is provided with a cover having a tear-away portion covering said opening and said cover being rotatable to align the opening with a corresponding reservoir opening.

8. A refill container as claimed in claim 7 including a lock means for maintaining the refill container in engagement with the reservoir.

9. A refill container as claimed in claim 8 wherein said lock means comprises a means for locking said cover to said reservoir as said cover is rotated to open the refill container to the reservoir.

10. A liquid dispenser comprising:

a housing a reservoir mounted within said housing; and a refill container mounted within said housing, and comprising:

a dispensing tube through which said liquid is dispensed from said dispenser;

container means for furnishing a primary supply of liquid to said dispensing tube during use and to said reservoir providing an auxiliary supply of liquid for said dispensing tube; and a fitment means for providing liquid communication between said container means and said reservoir in order to supply said reservoir from said container means and for providing for said auxillary supply of liquid to said dispensing tube upon substantial depletion of said primary supply.

11. A dispenser as in claim 10, and further comprising:

a closure of said fitment means operable to stop said liquid communication between said container means and said reservoir and said reservoir being removeable from said dispenser;

whereby said dispenser is operable to dispense said liquid without use of said reservoir upon closing said closure.

12. A dispenser as in claim 10, and further comprising:

means for checking a level of said liquid in said reservoir.

13. A dispenser as in claim 12, wherein said liquid level checking means comprises at least a translucent portion of said reservoir through which said liquid level may be detected visually.

14. A liquid dispenser as claimed in claim 13 wherein said reservoir is in communication with atmospheric pressure in order to equalize pressures in said dispenser and provide a visible liquid level.

* * * * *